US005662516A

United States Patent [19]

You

[11] Patent Number: 5,662,516

[45] Date of Patent: Sep. 2, 1997

[54] MAGNETIC BARREL TUMBLER

[76] Inventor: Jae Hyun You, 99 Bongik-Dong, Jongro-ku, Seoul, Rep. of Korea

[21] Appl. No.: 534,511

[22] Filed: Sep. 27, 1995

[51] Int. Cl.[6] ..... B24B 19/00

[52] U.S. Cl. ..... 451/113; 451/32; 451/35; 451/104; 451/326

[58] Field of Search ..... 451/32, 35, 104, 451/113, 326, 328, 330, 74

[56] References Cited

U.S. PATENT DOCUMENTS

| | | | |
|---|---|---|---|
| 2,787,854 | 4/1957 | Simjian | 451/131 |
| 2,880,554 | 4/1959 | Simjian | 451/113 |
| 3,848,363 | 11/1974 | Lovness et al. | 451/113 |
| 4,175,930 | 11/1979 | Sakulevich et al. | 451/28 |
| 4,211,041 | 7/1980 | Sakulevich et al. | 451/287 |
| 4,235,051 | 11/1980 | Spekman et al. | 451/35 |
| 4,549,370 | 10/1985 | Makedonski et al. | 451/113 |
| 4,599,826 | 7/1986 | Podoprigora | 451/177 |
| 5,044,128 | 9/1991 | Nakano | 451/32 |
| 5,419,735 | 5/1995 | Imahashi et al. | 451/35 |
| 5,449,313 | 9/1995 | Kordonsky et al. | 451/35 |

*Primary Examiner*—James G. Smith

*Assistant Examiner*—Dona C. Edwards

*Attorney, Agent, or Firm*—Dilworth & Barrese

[57] ABSTRACT

A magnetic barrel tumbler for polishing precious metal articles, including a motor case adapted to firmly support a motor therein, an outer housing mounted to an upper portion of the motor case, a magnetic disc placed in a space defined by both the outer housing and the motor case, the magnetic disc including a disc plate coupled to a shaft of the motor, and a plurality of magnets attached to an upper surface of the disc plate, the magnets being arranged in a fashion that those having opposite polarities face each other diametrically so that variations in magnetic field are induced during a rotation of the disc plate, a fixed plate spaced from an upper surface of the magnetic disc and fixedly mounted at an outer edge thereof to an inner surface of the outer housing, the fixed plate being made of a nonmetallic material, a polishing barrel laid on the fixed plate, the polishing barrel being provided with a protrusion at the central portion of an inner bottom surface thereof and with a chamber for containing articles to be polished and abrasives, and a lid mounted to an upper end of the polishing barrel and adapted to prevent the content of the polishing barrel from being outwardly discharged and to facilitate a replacement of the content and a washing of the polishing barrel.

10 Claims, 4 Drawing Sheets

MAGNETIC BARREL TUMBLER

BACKGROUND OF THE INVENTION

1. Field of the Invention

The present invention relates to a magnetic barrel tumbler for polishing precious metal castings by utilizing magnetic force, and more particularly to a magnetic barrel tumbler for hardening surface structures of metal castings and polishing surfaces of the metal castings by forcing the metal castings to be struck against polishing metal pins in a polishing barrel by utilizing variations in the magnetic field generated by the rotation of a magnetic disc disposed beneath the polishing barrel.

2. Description of the Prior Art

Generally, precious metal articles having particular shapes such as finger rings are cast by molds. Since such precious metal castings have a slightly instable surface structure after molding, they are subsequently polished manually.

For articles made of a metal, e.g., gold, silver, platinum, titanium or nickel, or a hard plastic material exhibiting a high degree of hardness, it is difficult to manually harden the surface structure. In this case, it takes much time to obtain a polished surface.

In order to solve this problem, various polishing devices have been developed. For example, U.S. Pat. No. 5,044,128 discloses a magnetically-polishing machine for mechanically polishing articles by utilizing variations in the magnetic field occurring during the rotation of a magnetic disc attached with magnets.

The polishing machine of the U.S. patent employs a magnetic disc, the surface of which is divided into alternating south-polar sectors or zones and north-polar sectors or zones. As the magnetic disc is rotated at high speed by a motor, a magnetic force is induced. That is, variations in the magnetic field occur. Due to such variations in the magnetic field, polishing pins, which are small metal pins disposed in a polishing vessel on the magnetic disc, are vibrated to polish articles contained in the polishing vessel.

The magnetic polarity on the upper surface of magnetic disc which induces variations in the magnetic field at the bottom of polishing vessel is made such that the zones having the same polarity are arranged at opposite positions, respectively. In other words, the polarity arrangement is made in the order of N, S, N, S, . . . in one direction along the magnetic disc surface (FIG. 3B). In this patent, the matrix of the magnetic disc is made of a nonmagnetic material.

Above the magnetic disc, a fixed plate comprised of a metal plate is disposed, on which the polishing vessel is laid.

In this construction, however, a lot of heat is generated between the fixed plate and the magnetic disc as variations in the magnetic field occur during a rotation of the magnetic disc. The heat interferes with an increase in the magnetic field variation. Furthermore, the alternating current (AC) motor disposed beneath the magnetic disc is affected by the heat, thereby giving an adverse effect on the overall operation of the machine.

Such phenomenons result from the fact that the fixed plate disposed above the magnetic disc is made of a metal exhibiting a certain electrical resistance and that the matrix of the magnetic disc is made of a nonmagnetic material. Since the magnetic disc and the fixed plate are constituted by non-metallic and metallic plates, respectively, heat is easily generated during a high-speed rotation of the magnetic disc.

Furthermore, the variable magnetic field induced by the high-speed rotation of the magnetic disc serves to generate a large quantity of heat when it passes through the metallic fixed plate.

In accordance with the patent, variations in the magnetic force are limited within a certain range so that the polishing work can be carried out only in the range. Due to such a limitation, it may be impossible to appropriately adjust the magnetic field variation range in accordance with the amount of articles to be polished in the polishing vessel. Where the amount of articles to be polished is large, appropriate polishing may not be achieved due to weak magnetic field. Since the bottom surface of polishing vessel is flat throughout all portions thereof, the central portion thereof is partially or not subjected to magnetic force. As a result, there is a problem that the efficiency of polishing work is degraded.

Meanwhile, barreling carried out in mechanical polishing machines is a process which mechanically agitates articles to be polished along with abrasives comprising polishing pins, polishing oil, etc. When a part of the polishing pins enter recesses defined in the articles being polished, they cannot move freely. As a result, efficient barreling cannot be achieved. In this regard, the vessel should have a shape capable of providing a smooth agitation of polishing pins. A strong force is required to provide a free agitation of polishing pins.

SUMMARY OF THE INVENTION

Therefore, an object of the invention is to solve the above-mentioned problem and to provide a magnetic barrel tumbler having a construction not only including the provision of a polishing barrel provided with a protrusion at the central portion of its bottom surface, a fixed plate made of a nonmetallic material, a magnet-attached disc plate made of steel and a controller for adjusting the magnetic field variation range on the basis of the quantity of articles to be polished, but also including the arrangement of magnets made such that magnets having different polarities are each arranged at symmetrical positions, thereby being capable of increasing the variations in the magnetic field while reducing the generation of heat, and controlling the magnetic field variation range, thus achieving an improvement in the efficiency of the polishing work.

In accordance with the present invention, this object is accomplished by providing a magnetic barrel tumbler comprising: a motor case adapted to firmly support a motor therein; an outer housing mounted to an upper portion of the motor case; a magnetic disc placed in a space defined by both the outer housing and the motor case, the magnetic disc including a disc plate coupled to a shaft of the motor, and a plurality of magnets attached to an upper surface of the disc plate, the magnets being arranged in a fashion that those having opposite polarities face each other diametrically so that variations in magnetic field are induced during a rotation of the disc plate; a fixed plate spaced from an upper surface of the magnetic disc and fixedly mounted at an outer edge thereof to an inner surface of the outer housing, the fixed plate being made of a nonmetallic material; a polishing barrel laid on the fixed plate, the polishing barrel being provided with a protrusion at the central portion of an inner bottom surface thereof and with a chamber for containing articles to be polished and abrasives; and a lid mounted to an upper end of the polishing barrel and adapted to prevent the content of the polishing barrel from being outwardly discharged and to facilitate a replacement of the content and a washing of the polishing barrel.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
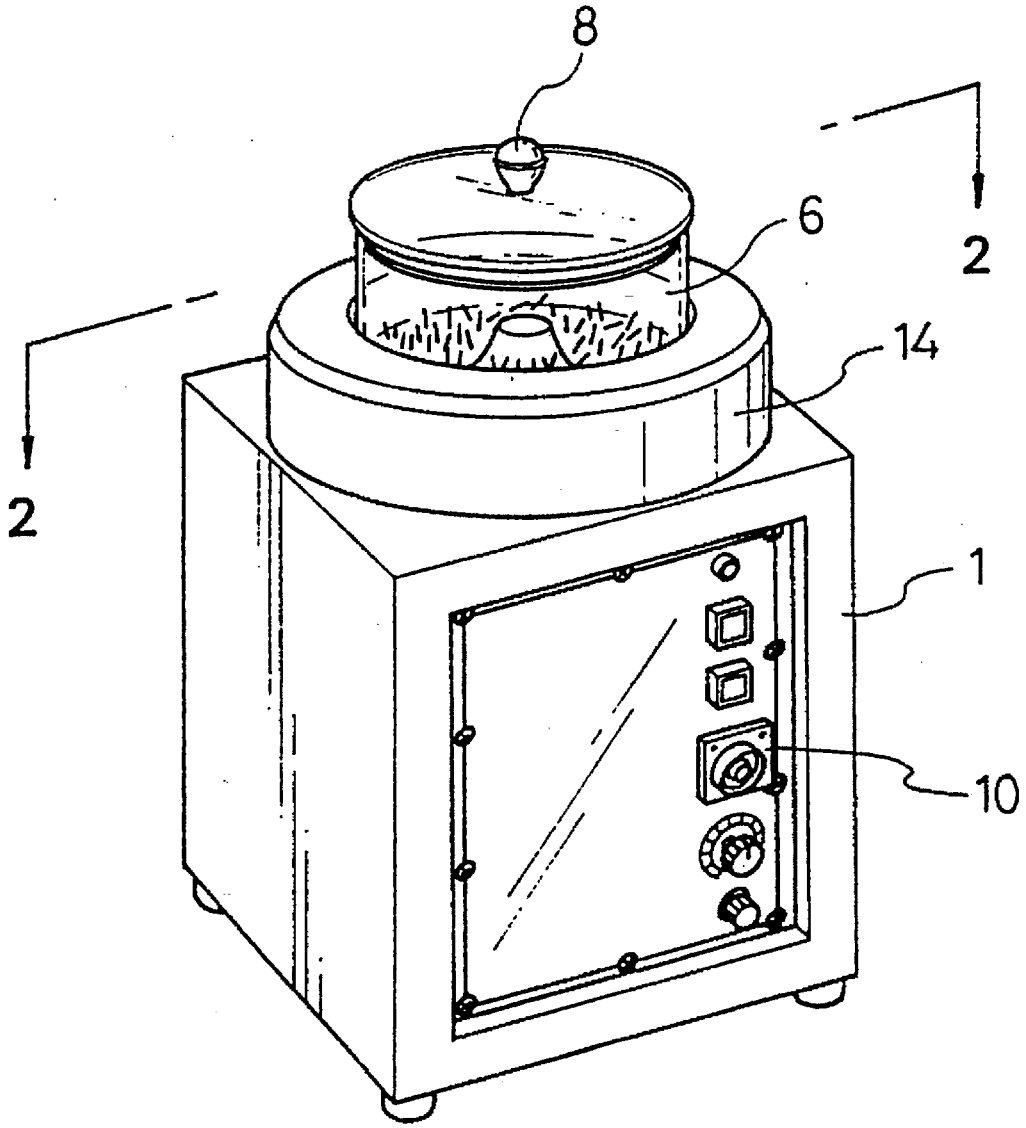
FIG. 1 is a perspective view illustrating a magnetic barrel tumbler in accordance with the present invention.

FIG. 1 is a perspective view illustrating a magnetic barrel tumbler as a polishing device in accordance with the present invention. On the other hand, FIG. 2 is a cross-sectional view taken along the line 2—2.

Figure 2:
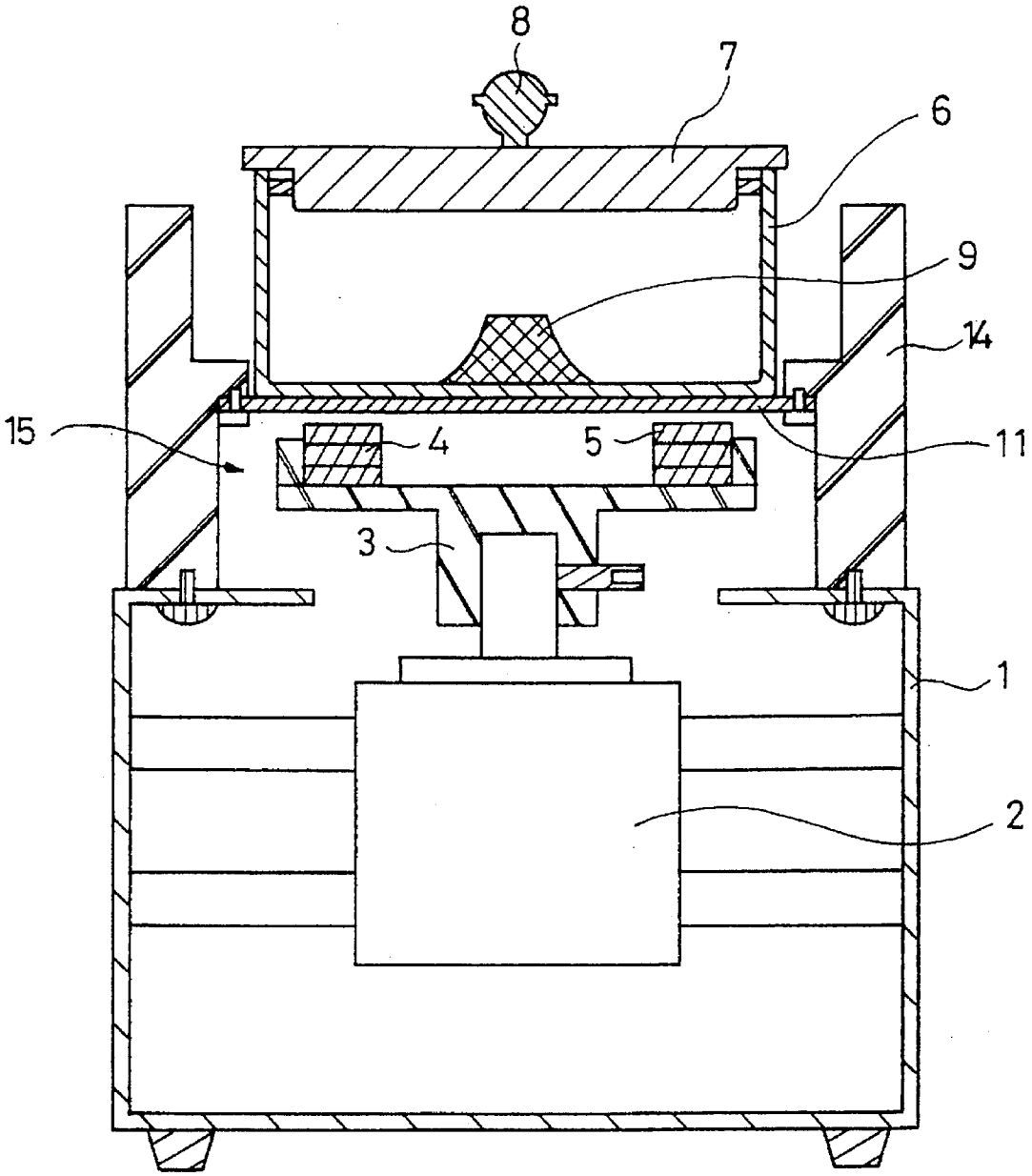
FIG. 2 is a cross-sectional view taken along the line 2—2.

As shown in FIGS. 1 and 2, the magnetic barrel tumbler of the present invention includes a motor case 1 in which a motor 2 is plated. The magnetic barrel tumbler also includes an outer housing 14 which constitutes an upper body of the magnetic barrel tumbler. The outer housing 14 is mounted on the upper portion of the outer housing 14. In the outer housing 14, a magnetic disc 15 is disposed. The magnetic disc 15 is coupled at its lower surface to the shaft of motor 2 so that it can be rotated at a high speed by the motor 2. On the upper surface of magnetic disc 15, N-polarity magnets 4 and S-polarity magnets 5 are arranged such that they face each other diametrically. A fixed plate 11 is disposed above the magnetic disc 15 such that it is upwardly spaced from the magnetic disc 15. The fixed plate 11 fixedly mounted to the inner surface of outer housing 14. The magnetic barrel tumbler also includes a polishing barrel 6 laid on the upper surface of the fixed plate 11. The polishing barrel 6 contains abrasives comprising polishing pins 13, an aqueous solution 12 and a polish, and precious metal articles to be polished. To the upper end of polishing barrel 6, a lid 7 mounted which prevents the content in the polishing barrel 6 from being outwardly discharged.

The motor 2, which is placed in the motor case 1 disposed at the lowest portion of the polishing device, is a direct current (DC) motor. The rotation speed of the motor can be freely controlled by a controller 10 placed at the outer surface of motor case 1.

To the bottom of motor case 1, a plurality of support members are attached to support the overall weight of the polishing device.

The magnetic disc 15, which is connected to the shaft of motor 2 to be rotated by the motor 2 and made of a metallic material such as steel, includes a disc plate 3 and a plurality of magnets 4 and 5 attached to the upper surface of disc plate 3.

Since the disc plate 3 is made of steel, it can induce high variations in the magnetic field when it is rotated at a high speed along with the magnets 4 and 5 by the drive force from the motor 2. If the disc plate 3 is made of a nonmetallic material exhibiting nonmagnetic property as in the U.S. Pat. No. 5,044,128, the variations in the magnetic field induced by the rotation of the magnets 4 and 5 attached to the disc plate 3 is rather limited. In accordance with the present invention, an improvement in the magnetic field variations is ensured by virtue of the disc plate 3 made of metal.

Figure 3A:
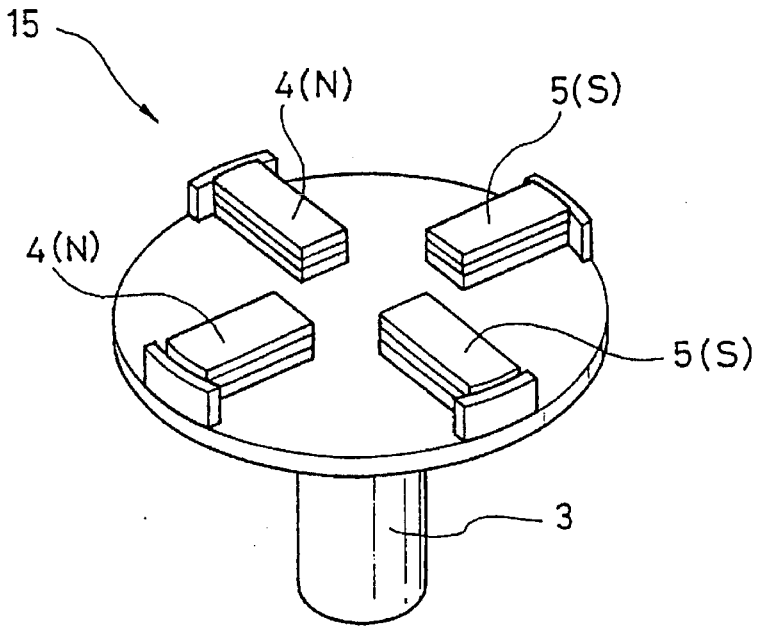
FIG. 3A is a perspective view illustrating a magnetic disc shown in FIG. 2.
Figure 3B:
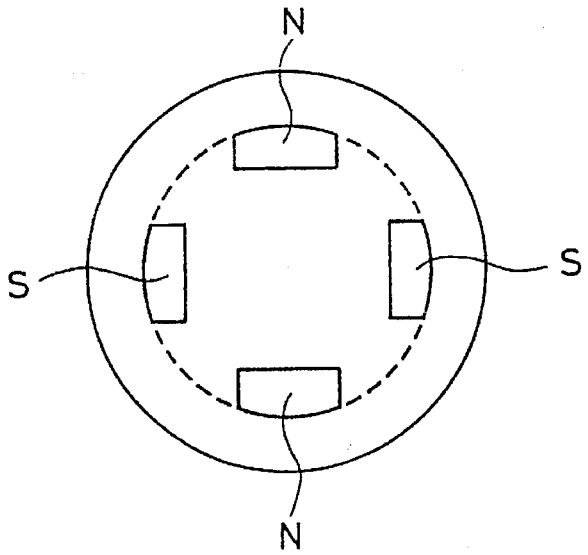
Fig. 3B PRIOR ART
FIG. 3B is a plan view illustrating a magnetic disc attached with magnets arranged in a conventional manner.

Although the U.S. Pat. No. 5,044,128 cannot provide an increased magnetic field variation range because the portions of the magnetic disc are arranged such that ones having the same polarity are disposed at opposite positions, respectively, as shown in FIG. 3B, the present invention provides an increased magnetic field because magnets 4 and 5 having different polarities are arranged at symmetrical positions, respectively, as shown in FIG. 3A. In other words, the magnets 4 and 5 are arranged at opposite positions, respectively.

Where four magnets are arranged on the upper surface of disc plate 3 in a circumferential direction in accordance with the present invention, their arrangement is made in the order of N, N, S, and S such that facing magnets have different polarities, respectively. In the case of U.S. Pat. No. 5,044,128, the magnet arrangement is made in the order of N, S, N, S, . . . such that magnets having the same polarity are arranged at opposite positions, respectively.

Since the magnet arrangement is made such that magnets having different polarities are arranged at opposite positions respectively, in accordance with the present invention, an increase in the magnetic field variation range is ensured.

The fixed plate 11, which is upwardly spaced from the upper surface of magnetic disc 15 and fixedly mounted to the inner surface of outer housing 14, is made of a nonmetallic material, such as ceramic glass, not influenced by the magnetic field. Accordingly, the fixed plate 11 restrains generation of heat in the process of inducing a magnetic field by the magnetic disc 15 while having no influence on the induced magnetic field.

Figure 4:
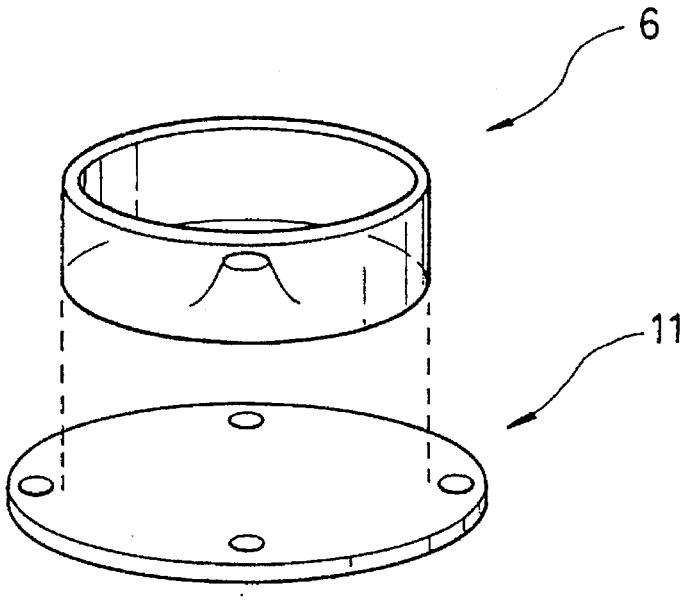
FIG. 4 is a perspective view illustrating a polishing barrel and a fixed plate in accordance with the present invention.
Figure 5:
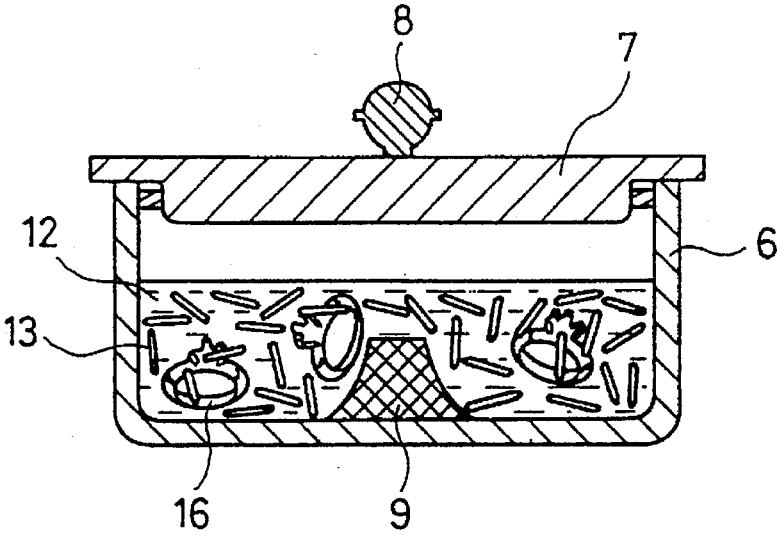
FIG. 5 is a sectional view illustrating the polishing barrel in a using state.

FIG. 4 is a perspective view illustrating the polishing barrel and fixed plate included in the magnetic barrel tumbler in accordance with the present invention. FIG. 5 is a sectional view illustrating the polishing barrel in a using state.

As shown in the figures, the fixed plate 11 made of nonmetallic material has an area slightly larger than the bottom area of the polishing barrel 5 so that it can allow the polishing barrel 5 to be laid thereon.

The polishing barrel 6, which is laid on the fixed plate 11 such that its bottom surface is in direct contact with the upper surface of fixed plate 11, has a chamber for containing precious metal articles 16, such as finger rings, to be polished and an abrasive for polishing the articles. The abrasive includes polishing pins 13 made of metal, an aqueous solution 12 for restraining shaking of polishing pins 13 and washing off the polished particles on the articles, and a polish (not shown) for polishing the surfaces of articles.

The polishing barrel 6 can be simply laid on the fixed plate 11 using the user's hands. During the polishing operation of the device, the polishing barrel 6 is maintained in a fixed state on the fixed plate 11 without being rotated by the magnetic disc 15. By the rotation of the magnetic disc 15, only the polishing pins 13 contained in the polishing barrel 6 are shaken.

In order to effectively polish the articles 16 at the central portion of polishing barrel 6 where a weak magnetic field exists, the polishing barrel 6 has a protrusion 9 upwardly protruding to a certain height from the central portion of the bottom surface thereof.

The polishing pins 13 are comprised of bar-shaped metal pins made of stainless steel and have a thickness of 0.3 to 0.5 mm and a length of 3 to 5 mm. The polishing pins 13 are severely shaken in the polishing barrel 6 by the magnetic field induced by the magnetic disc 15. During the shaking, the polishing pins 13 strike the surfaces of the articles 16, such as finger rings, contained in the polishing barrel 6, thereby polishing them.

At this time, the aqueous solution 12 contained in the polishing barrel 6 serves to smoothly restrain the shaking of polishing pins 13. The aqueous solution 12 also acts to wash off the polished particles on the articles 16.

The lid 7 mounted to the upper end of polishing barrel 6 prevents the content of the polishing barrel 6 from being outwardly discharged. The lid 7 has a knob 8 at its upper surface in order to achieve easy handling of the lid upon replacing the content of polishing barrel 6.

Now, the process of polishing precious metal articles made of a metallic or plastic material using the magnetic barrel tumbler which is the above-mentioned polishing device according to the present invention will be described in conjunction with all the figures.

For polishing articles 16 such as finger rings, abrasives comprising an aqueous solution 12, a polish and polishing pins 13 are added into the polishing barrel 6 together with the articles 16 to be polished. Thereafter, the polishing barrel 6 is closed by the lid 8.

The polishing barrel, which contains the polishing pins 13, aqueous solution 12, a polish and articles 16 therein, is then laid on the fixed plate 11 fixedly placed in the interior of outer housing 14.

The motor 2 is then driven to rotate the magnetic disc 15 which is coupled to the shaft of the motor. The magnetic disc 15 is rotated at a speed of about 2,000 to 3,000 RPM for about one or two hours.

Such a high-speed rotation of the magnetic disc 15 results in variations in the magnetic field induced by the magnets 4 and 5 attached to the upper surface of disc plate 3. Due to such magnetic field variations, the polishing pins 13 are severely shaken in upward and downward directions in the polishing barrel 6 disposed above the magnetic disc 15.

As the polishing pins 13 are severely shaken, they strike the surfaces of articles 16 in the polishing barrel 6, thereby polishing them. At this time, the polished particles on the articles 16 are washed off by the aqueous solution.

After the polishing work is carried out by rotating the magnetic disc 15 for about one hour, the articles 16 are uniformly polished at both inner and outer surfaces thereof, so that they have the inherent luster of their metal or plastic material.

Thereafter, the polished articles 16 are taken out of the polishing barrel 6 and are then manually polished again separately.

As apparent from the above description, the disc plate coupled at its lower surface to the motor in the magnetic barrel tumbler is made of metal such as steel and is attached at its upper surface with magnets arranged such that those having different polarities are placed at opposite positions, respectively. Accordingly, large variations in the magnetic field are induced when the disc plate is rotated at a high speed by the motor. In accordance with the present invention, generation of heat upon the rotation of magnetic disc can be restrained by the fixed plate which is upwardly spaced from the magnetic disc and made of a nonmetallic material such as ceramic glass. The magnetic barrel tumbler also includes the controller capable of controlling the rotation speed of the motor, thereby optionally controlling the magnetic field variation range on the basis of the quantity of articles to be polished. Since the polishing barrel has the protrusion at the central portion of its bottom surface, it is possible to effectively polish the articles at the central portion of the polishing barrel where a weak magnetic field exists. Thus, the present invention can harden surface structures of precious metal castings and polish surfaces of the metal castings effectively.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A magnetic barrel tumbler comprising:

a motor case adapted to firmly support a motor therein;

an outer housing mounted to an upper portion of the motor case;

a magnetic disc placed in a space defined by both the outer housing and the motor case, the magnetic disc including a disc plate coupled to a shaft of the motor, and a plurality of magnets attached to an upper surface of the disc plate, the magnets being arranged in a fashion that those having opposite polarities face each other diametrically so that variations in magnetic field are induced during rotation of the disc plate;

a fixed plate spaced from an upper surface of the magnetic disc and fixedly mounted at an outer edge thereof to an inner surface of the outer housing, the fixed plate being made of a nonmetallic material;

a polishing barrel laid on the fixed plate, the polishing barrel having a protrusion at a central portion of an inner bottom surface thereof and with a chamber for containing articles to be polished and abrasives; and a lid mounted to an upper end of the polishing barrel and adapted to prevent contents of the polishing barrel from being outwardly discharged and to facilitate a replacement of the polishing barrel contents and a washing of the polishing barrel;

wherein the disc plate of the magnetic disc is made of steel.

2. The magnetic barrel tumbler in accordance with claim 1, wherein the nonmetallic material of the fixed plate is ceramic glass.

3. The magnetic barrel tumbler in accordance with claim 1, further comprising a controller mounted to an outer surface of the motor case and adapted to control a rotation speed of the motor.

4. The magnetic barrel tumbler in accordance with claim 1, wherein the abrasives contained in the polishing barrel comprise polishing pins, an aqueous solution and a polish, each of the polishing pins being a metal pin having a thickness of 0.3 to 0.5 mm and a length of 3 to 5 mm.

5. A magnetic barrel tumbler comprising:

a motor case adapted to firmly support a motor therein;

an outer housing mounted to an upper portion of the motor case;

a magnetic disc placed in a space defined by both the outer housing and the motor case, the magnetic disc consisting essentially of a disc plate coupled to a shaft of the motor, and a plurality of magnets attached to an upper surface of the disc plate, each of the magnets being arranged in a fashion such that those having opposite polarities face each other diametrically so that variations in magnetic field are induced during a rotation of the disc plate, wherein the disc plate of the magnetic disc is composed of a ferromagnetic material;

a fixed plate spaced from an upper surface of the magnetic disc and fixedly mounted at an outer edge thereof to an inner surface of the outer housing;

a polishing barrel laid on the fixed plate, the polishing barrel being provided with a protrusion at a central portion of an inner bottom surface thereof and with a chamber for containing articles to be polished and abrasives; and a lid mounted to an upper end of the polishing barrel and adapted to prevent contents of the polishing barrel from being outwardly discharged and to facilitate a replacement of the polishing barrel contents and a washing of the polishing barrel.

6. The magnetic barrel tumbler according to claim 5, wherein the ferromagnetic material comprises steel.

7. The magnetic barrel tumbler according to claim 5 wherein the fixed plate is composed of a nonmetallic material.

8. A magnetic barrel tumbler comprising:

a motor case adapted to firmly support a motor therein;

an outer housing mounted to an upper portion of the motor case;

a magnetic disc placed in a space defined by both the outer housing and the motor case, the magnetic disc including a disc plate composed of a ferromagnetic material coupled to a shaft of the motor, and a plurality of magnets attached to an upper surface of the disc plate, the magnets being arranged in a fashion such that those having opposite polarities face each other diametrically so that variations in magnetic field are induced during a rotation of the disc plate;

a fixed plate spaced from an upper surface of the magnetic disc and fixedly mounted to an outer edge thereof to an inner surface of the outer housing;

a polishing barrel laid on the fixed plate for containing articles to be polished and abrasives; and a lid mounted to an upper end of the polishing barrel and adapted to prevent contents of the polishing barrel from being outwardly discharged and to facilitate a replacement of the polishing barrel contents and a washing of the polishing barrel.

9. The magnetic barrel tumbler in accordance with claim 8, wherein the ferromagnetic material comprises steel.

10. The magnetic barrel tumbler in accordance with claim 8, wherein the fixed plate is composed of ceramic glass.

* * * * *